United States Patent [19]

Weisman

[11] 3,988,865

[45] Nov. 2, 1976

[54] CLAMP AND JIG FOR USE THEREWITH

[76] Inventor: Charles Weisman, 125 N. Montgomery St., Valley Stream, N.Y. 11580

[22] Filed: Feb. 18, 1975

[21] Appl. No.: 550,321

Related U.S. Application Data

[63] Continuation-in-part of Ser. No. 337,375, March 2, 1973, abandoned.

[52] U.S. Cl. ..... 51/228; 269/196; 269/234

[51] Int. Cl.[2] ..... B24B 19/00

[58] Field of Search ..... 269/196, 198, 233, 234, 269/236; 51/217 R, 228

[56] References Cited

UNITED STATES PATENTS

| | | | |
|---|---|---|---|
| 338,458 | 3/1886 | Abernethy | 269/234 X |
| 451,283 | 4/1891 | Webb | 269/233 X |
| 851,661 | 4/1907 | Hewlett | 269/236 |
| 2,514,292 | 7/1950 | Paulson | 269/234 X |
| 2,591,636 | 4/1952 | Thompson | 269/233 X |
| 2,850,931 | 9/1958 | Conway | 269/233 X |
| 3,108,794 | 10/1963 | Blatt | 269/233 |

*Primary Examiner*—Harold D. Whitehead
*Attorney, Agent, or Firm*—Bauer, Amer & King

[57] ABSTRACT

An improved clamp is disclosed in which a carrier plate is mounted slidably within a housing and is moved in one embodiment in a linear direction by means of an actuator. First and second arms are mounted in the housing and in angularly oriented guide slots within the carrier plate whereby, when the actuator moves the carrier plate, the arms move so that jaws at the ends of the arms converge at a clamping position. A pin in each arm is engaged in its own slot in the housing to insure that the jaws move along a predetermined path. In one embodiment of the invention only one of the arms is movable and the other arm is fixed. In a second, self-centering embodiment of the invention both arms move towards each other and equal and opposite bending stresses are induced in the arms which bend the arms within the elastic limit of the metal.

The aforementioned Abstract is neither intended to define the invention of the application which, of course, is measured by the claims, nor is it intended to be limiting as to the scope of the invention in any way.

11 Claims, 9 Drawing Figures

CLAMP AND JIG FOR USE THEREWITH

This application is a continuation-in-part of copending application Ser. No. 337,375, filed Mar. 2, 1973, and now abandoned.

BACKGROUND OF THE INVENTION

1. Field of the Invention

This invention relates generally to clamps and to a jig for use therewith.

2. Description of the Prior Art

There are many examples of clamps in the prior art but few, if any, combine with a large holding power the highly desirable features of being both self-centering and capable of accepting a wide range of workpiece thicknesses without adjusting the position of one jaw relative to the other. Over-centering or "knuckle" type clamps are typical examples of the prior art.

However, when a high degree of accuracy is desirable, where rapid opening and closing of the clamp is needed and where great holding power is required it has been found that prior art clamps have not been entirely satisfactory.

One example of where the prior art clamps have not been entirely successful is in a jig for sharpening ice-skate blades. It is well known that the blades of figure, hockey and speed skates each have a different thickness and that a range of thicknesses are also available for each type of blade. In addition, figure blades are also tapered from toe to heel, are hollow ground on the bottom and may even be hollow ground on the sides to produce a sharp edge.

Normally, ice skate blades are clamped in a jig and brought into engagement with an abrasive member such as a rotating grinding stone that has been very accurately dressed. If the clamp is not self-centering it will be impossible to apply the entire length of the blade to the same spot on the stone, particularly if the blade thickness varies, as described above. If the clamp cannot accept a range of thickness and still be self-centering it will be virtually worthless for use with all the different thickness ice skate blades. That is, the clamp jaws or the entire jig would have to be adjusted to suit each blade thickness and this would be intolerably time consuming.

SUMMARY OF THE INVENTION

In its broadest aspect the present invention provides a clamp having two jaws at least one of which is movable with respect to the other. The jaws are mounted on resilient, elongated arms and, in the embodiment where only one jaw is movable, that arm is slidably guided within an elongated recess formed in a carrier plate linearly and, in cooperation with a pin integral with the movable arm and a slot formed in the housing, determines the direction of movement of the arm.

In another aspect of this invention the clamp is self-centering since both arms and the jaws integral therewith are movable towards and away from each other. Both arms are contained within angularly oriented, elongated recesses in the carrier plate and both arms are guided by the pin and slot arrangement described hereinabove. With the second embodiment there is the highly desirable self-centering feature that permits the present invention to grip a range of workpiece thicknesses without adjusting the position of either jaw and to be used in a jig either singularly or in pairs, such as for example in a jig used to sharpen ice skate blades.

In both of the embodiments of the invention a bending strain may be imparted to the arms carrying the attached clamping pads so as to increase the holding power of the jaws by virtue of the induced stress. The bending strain in each arm is equal and oppositely directed so that, together with the self-centering feature a high degree of clamping power and accuracy is obtainable.

Accordingly, it is an object of the present invention to provide an improved clamp.

Another object of the present invention is to provide an improved clamp, as described above, wherein superior holding power is provided.

Another object of the present invention is to provide an improved, self-centering clamp, as described above, that is capable of accommodating a range of workpiece thicknesses without adjusting the position of the jaw.

These and other objects, features and advantages of the invention will, in part, be pointed out with particularity and will, in part, become obvious from the following more detailed description of the invention, taken in conjunction with the accompanying drawing which forms an integral part thereof.

BRIEF DESCRIPTION OF THE DRAWING

In the various figures of the drawing like reference characters designate like parts.

In the drawing.

DESCRIPTION OF THE PREFERRED EMBODIMENT

Figure 1:
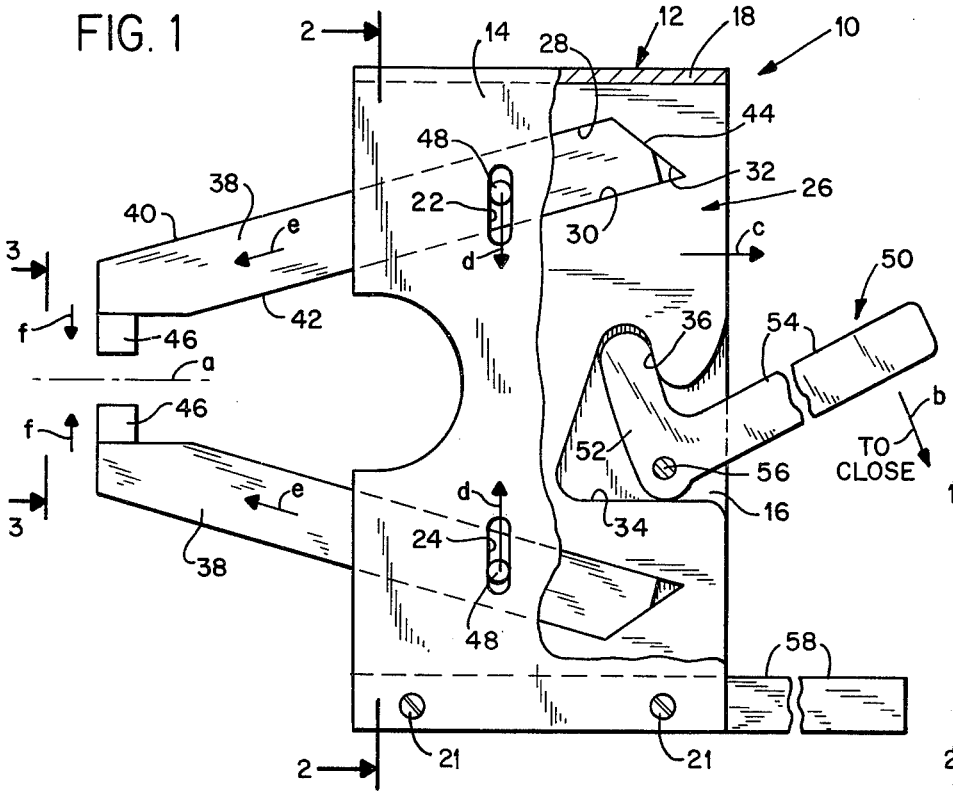
FIG. 1 is an elevational view, partially broken away and partially in section, illustrating the open condition of a clamp comprising the present invention.
Figure 2:
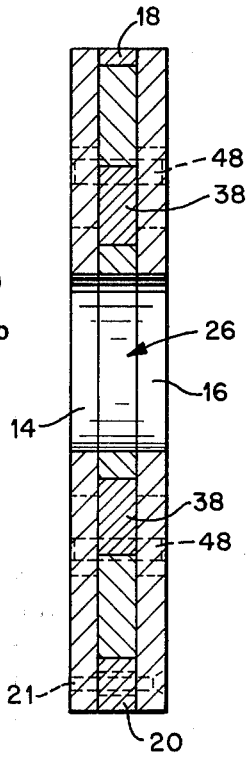
FIG. 2 is a sectional, elevational view taken along line 2—2 of FIG. 1.
Figure 3:
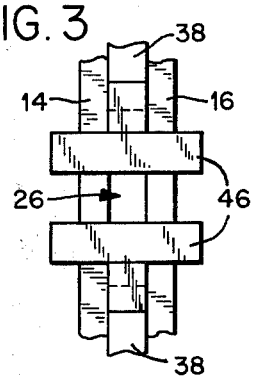
FIG. 3 is a fragmentary, elevational view taken along line 3—3 of FIG. 1.
Figure 4:
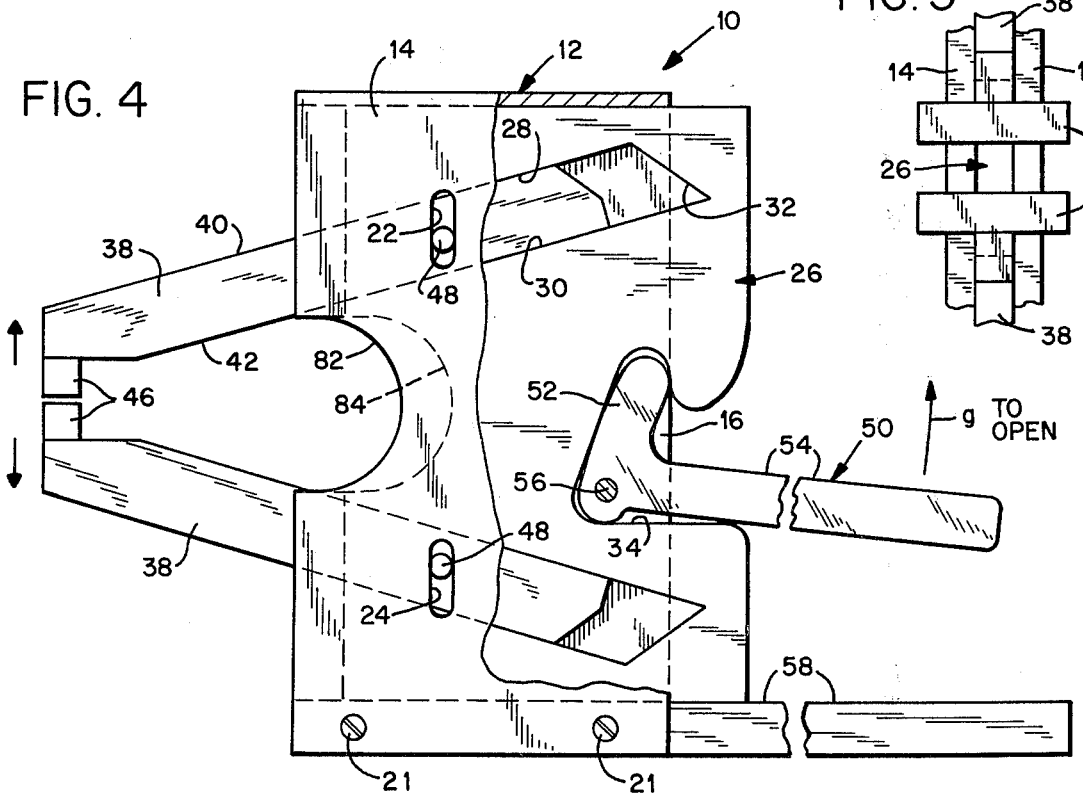
FIG. 4 is an elevational view, partially broken away and partially in section and similar to FIG. 1 but showing the clamp thereof in the closed condition.

Referring now to FIGS. 1–4 there is shown a self-centering clamp 10 comprising the present invention. Clamp 10 includes a housing generally designated by the reference character 12 which is formed of a pair of spaced apart plates 14 and 16 respectively. Spacers 18 and 20 are used to separate the plates 14 and 16 and fasteners such as screws 21 to join the plates 14 and 16 to each other. In each of the plates 14 and 16 there is provided a pair of elongated slots 22 and 24. Although the slots 22 and 24 are only shown in the plate 14 it should be clearly understood that similar slots 22 and 24 are also provided in the plate 16. It should be further noted that the axes of the slots 22 and 24 are colinear.

A carrier plate 26 is slidably mounted within the housing 12 and is movable along a path that is perpendicular to the colinear axes of the slots 22 and 24. The spacers 18 and 20 serve as guide means for the accurate and linear sliding of the carrier plate 26. A pair of open ended elongated guide means defined by recesses that include opposed walls 28 and 30 and an end wall 32 are formed in the carrier plate 26. The recesses are formed at equal and opposite acute angles to a center line designated by the reference character a. In addition, one end edge of the carrier plate 26 is provided with a generally triangular cut out 34 that includes a shoulder 36, the purpose for which will be described hereinafter. A pair of slightly yieldable elongated arms 38 are slidably mounted in the recesses defined by the walls 28, 30 and 32. Each of the arms 38 is defined by longitudinally extending side edges 40 and 42 and an end edge 44. At their opposite, outer most ends, the arms 38 are provided with opposed jaws 46. In addition, each arm 38 has a pin 48 extending therethrough, the pins 48 being in engagement with the slots 22 and 24.

In one embodiment of this invention the carrier plate 26 is displaced along an axis defined by the reference character a by lever means 50, for example, an L-shaped lever having a first leg 52 and a second leg 54. A pin 56 pivotally mounts the lever 50 to the housing walls 14 and 16. A fixed, cooperating handle 58 is formed integrally with and extending outwardly from the spacer 20 in spaced opposition to the lever means 50. Alternatively, equivalent linkage means may be used in place of the lever means 50.

In order to close the jaws 46 of the clamp 10 the lever 50 is rotated in a clockwise direction as shown by the arrow *b* in FIG. 1. In one version of the present invention the lever 50 and the handle 58 are close enough together so as to be gripped in one hand. When the lever 50 moves in a counterclockwise direction the leg 52 thereof will bear against and push the shoulder 36 to the right as shown by the arrow *c* in FIG. 1. Since the pins 48 are limited to movement only in the direction of the arrows *d* in FIG. 1, which direction is perpendicular to the line *a* in FIG. 1, the arms 38 will slide along the walls 28 and 30 in a direction shown by the arrows *e* due to the inclined plane effect. Thus, the jaws 46 will self-centeringly move in the direction of the arrows *f* in FIG. 1 to the clamping position shown in FIG. 4. The jaws 46 may be opened by angularly displacing the handle 50 counterclockwise as shown by arrow *g* in FIG. 4.

In one embodiment of this invention the arms 38 have approximately a 4:1 mechanical advantage and the lever 50 has approximately a 6:1 mechanical advantage. Thus, there will be a multiplication factor of approximately 24 between the input force and the clamping force. Moreover, the clamping force will be uniform, predictable and readily repetitive assuming a constant or uniform input force such as may be imparted by a motor, for example. It should be understood that the invention is not limited to the foregoing parameters and that they are given by way of example only.

Figure 5:
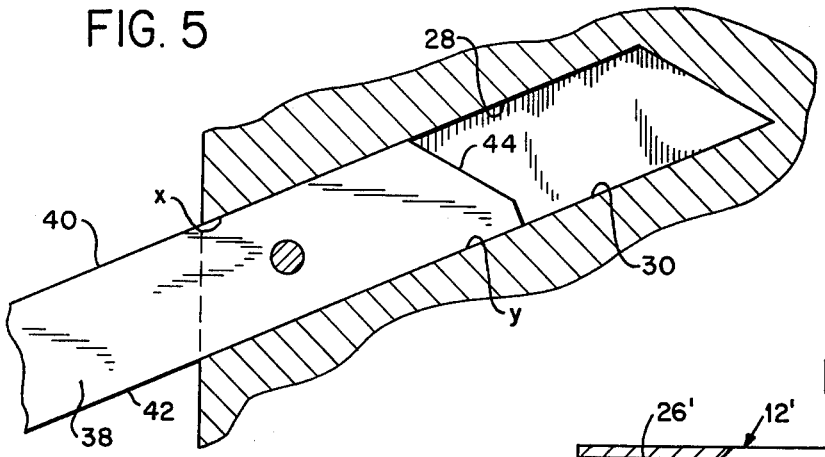
FIG. 5 is an enlarged schematic view, partially in section, illustrating one feature of the present invention.

An advantageous feature of the present invention is shown schematically in FIG. 5. When the jaws 46 have reached the clamping position shown in FIG. 4 a continued clockwise movement of the lever 50 in the direction shown by the arrow *b* will cause a linear bending stress to be induced in each of the arms 38. The arms are so proportioned as to prevent the stress from permanently deforming, or exceeding the elastic limit of the metal. This is, the wall 28 approximately at the point designated *x* in FIG. 5 will bear downwardly against the longitudinal edge 40 of the arm 38. At the same time the wall 30, approximately at the point *y* will exert an upward force against the longitudinal edge 42 of the arm 38. Reaction forces of the arm 48 will be upward against the point *x* and downward against the point *y*. Thus, bending stresses are imparted to the portion of the arms 38 that contain the jaws 46 so as to tend to "load" the arms 38. As a result, since the upper arm 38 is stressed in an upward direction away from dashed line z in the vicinity of the jaw 46 and the lower arm 38 is stressed in a downward direction in the vicinity of the jaw 46, there will be a tendency for the arms 38 to want to return to their natural state so that forces in a direction of the arrows f will be stored in the arms 38 to thereby provide an additional holding force. Since the arms 38 are sufficiently stiff the clamping pads 46 remain square and thus hold the workpiece rigidly.

Figure 6:
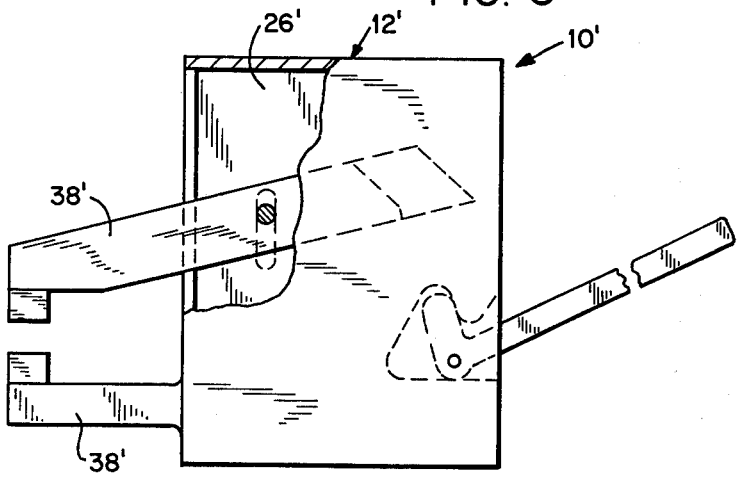
FIG. 6 is an elevational view, partially in section and partially broken away illustrating an alternative embodiment of the present invention.

In FIG. 6 an alternative embodiment of the present invention is disclosed. The clamp 10' operates in substantially the same manner as described hereinabove. However, only the upper arm 38' is movable while the lower arm 38' is rigidly secured to the housing 12'. In this connection it should be noted that only one recess need be provided in the carrier 26'. The embodiment disclosed in FIG. 6 provides substantially all of the features inherent in the first described embodiment with the exception of the self-centering feature.

Figure 7:
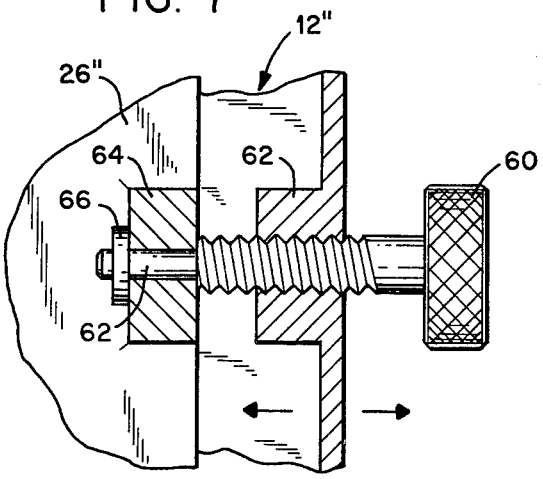
FIG. 7 is a fragmentary, sectional view illustrating another, alternative embodiment of the present invention.
Figure 10:
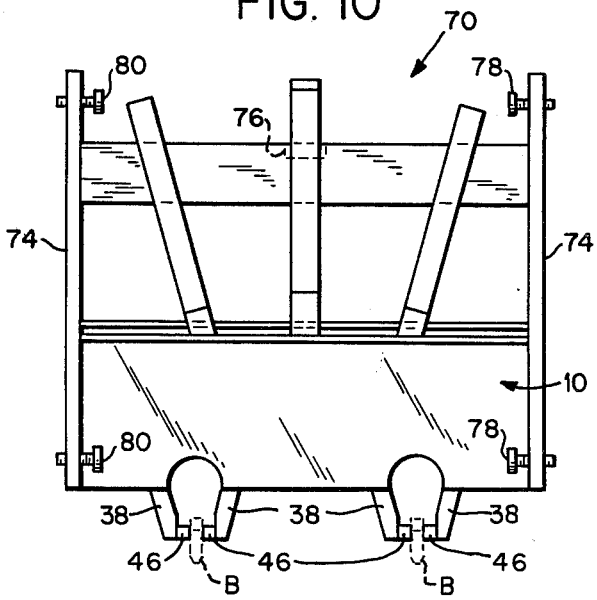
FIG. 10 is an elevational view taken along line 10-10 of FIG. 8.

Turning now to FIG. 7 there is disclosed an alternative means for actuating the carrier plate 26''. Instead of using the pivotally mounted lever 50 a screw 60 is threaded into a boss 62 that is formed integrally with the housing 12''. A reduced diameter end portion 62 of the screw 60 passes through a block 64 formed integrally with the carrier plate 26'', and is rotatably captured therein by means of a retaining ring 66 or equivalent structure. It will be appreciated that the screw 60 can advance the carrier plate 26'' to the right or left in the same manner as described in connection with the first embodiment.

Figure 8:
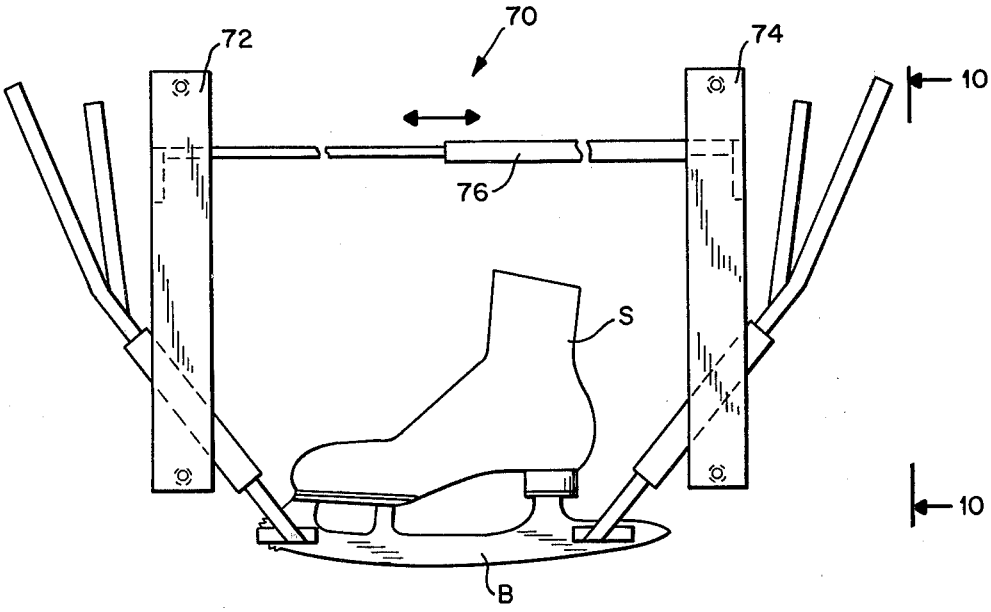
FIG. 8 is a plan view illustrating the combination of the clamp comprising the present invention and a jig for sharpening ice skate blades that may be used in combination therewith.
Figure 9:
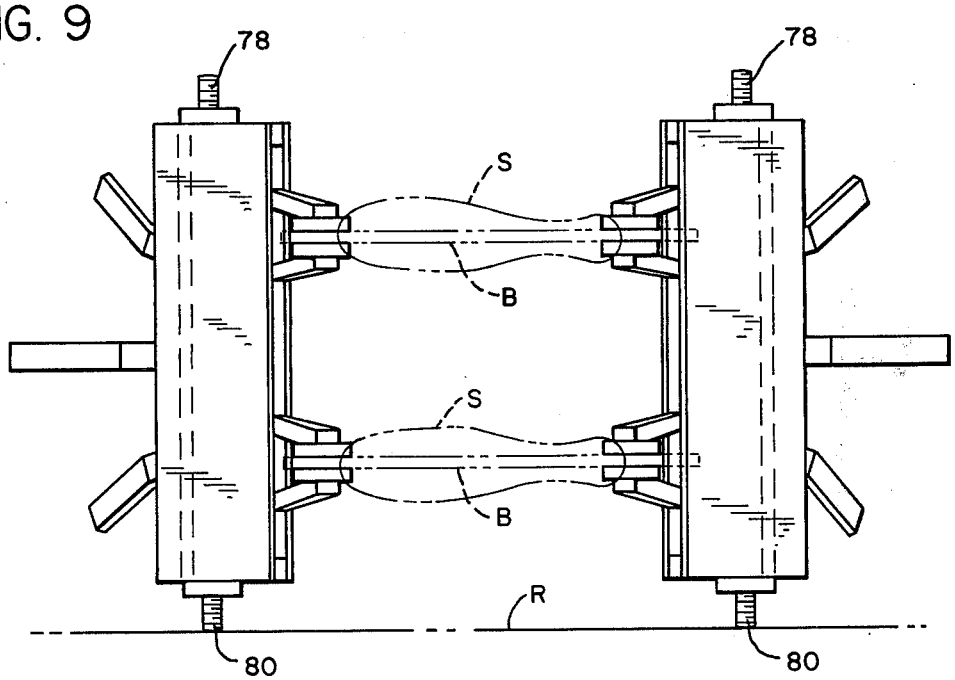
FIG. 9 is a front elevational view of the apparatus shown in FIG. 8.

FIGS. 8 and 9 are used to illustrate the manner in which the clamp comprising the present invention may be used with a jig, for example a jig for sharpening ice skate blades. The jig 70 is comprised of first and second frame members 72 and 72 and means 76 for adjustably connecting frame members 72 and 74. Adjusting screws 78 and 80 are threadably mounted in the first and second frame members 72 and 74. Preferably, the housing plates 14 and 16 as well as the carrier plate 26 are notched as shown by the reference characters 82 and 84 so as not to interfere with the ice skate S when the blade B thereof is clamped. While a pair of ice skates S are shown in FIG. 9 it is preferred that only one blade be sharpened at a time. For this purpose the adjusting screws 78 and 80 are provided so that the height of the jig 70 may be varied with respect to a reference surface and so that the jig 70 may be inverted. It should also be evident that it is within the scope of the present invention to provide a jig with only a single pair of clamps.

While the foregoing description has referred to the linear movement of the carrier plate and to the arms it should be clearly understood that the present invention is not so limited. It is also within the scope of the present invention to utilize arcuate motion which may or may not be uniform. In some special applications it may be desirable to use a camming action wherein there may be relatively fast or slow segments of motion.

There has been disclosed heretofore the best embodiment of the invention presently contemplated. However, it is to be understood that various changes and modifications may be made thereto without departing from the spirit of the invention.

What I claim as new and desire to secure by Letters Patent is:

1. A clamp for holding a workpiece, said clamp comprising:

a. a housing;

b. a linearly movable carrier slidably mounted in said housing;

c. actuator means for causing relative movement between said housing and said carrier;

d. first and second arms including, respectively integral first and second jaw means having gripping surfaces in opposition to each other for holding the workpiece therebetween, said arms being capable of being stressed under strain to bend them into an arcuate shape while holding the workpiece; and e. means for drivingly coupling at least one of said arms and the jaw means integral therewith to said carrier for displacement thereby and to said housing for limiting said coupled jaw means to linear movement in a direction perpendicular to the direction of movement of said carrier whereby the plane of said coupled jaw means is always parallel to the plane of the workpiece, said linear movement of said coupled jaw means being towards a clamping position adjacent said other jaw means and away therefrom when there is relative displacement between said housing and said carrier, and wherein said means for coupling said arm to said carrier and to said housing comprises an elongated slot in said housing and a pin integral with said arm and in engagement with said slot, the axes of said slot being substantially perpendicular to the direction of movement of said carrier, said coupling means further including guide means for displacing said one arm along a path at an acute angle to the direction of movement of said carrier comprising an elongated recess in said carrier, the recess in said carrier having generally opposed side walls, at least a portion of which bear against a portion of said arms.

2. The clamp in accordance with claim 1 wherein a portion of said side walls of the recess and a portion of the side edges of said arms define cooperating surface means for applying a bending strain to said one arm when said jaw means thereof is in the clamping position.

3. The clamp in accordance with claim 1 wherein said actuator means comprises lever means pivotally mounted in said housing and a shoulder formed integrally with said carrier whereby when one portion of said lever means is displaced angularly about the pivot point thereof, another portion of said lever means will bear against said shoulder and thereby displace said carrier.

4. The clamp in accordance with claim 1 wherein said actuator means comprises a screw threadably received in said housing and coupled to said carrier.

5. The clamp in accordance with claim 1 where there is further included means for coupling both said arms and their respective jaw means to said carrier and said housing, both said jaw means being thereby movable in a first direction towards each other to define said clamping position and a second direction away from each other whereby said clamp is selfcentering and adapted to engage a range of workpiece thicknesses without adjusting the position of one of said jaw means with respect to said other jaw means.

6. The clamp in accordance with claim 5 wherein cooperating surface means are included on both said arms as well as on portions of said carrier adjacent thereto for applying a bending stress to said arms when said jaw means thereof are in the clamping position.

7. The clamp in accordance with claim 6 wherein said means for coupling said arms to said carrier and to said housing comprises a pair of spaced apart elongated slots, one of each of said slots being positioned adjacent said arm and a pin integral with each said arm and in engagement with said respective slot, the axes of said slots being colinear with each other and substantially perpendicular to the direction of movement of said carrier, said coupling means further comprising guide means for each said arms for displacing said arms along converging paths that are at an angle to the direction of movement of said carrier.

8. The clamp in accordance with claim 7 wherein said means for guiding said arms with respect to said carrier comprises a pair of elongated recesses in said carrier, said recesses in said carrier having generally opposed side walls, at least a portion of which bear against a portion of said arms.

9. The clamp in accordance with claim 8 wherein a portion of said side walls of said slots and a portion of the side edges of said arms define cooperating surface means for applying a bending stress to said arms when said jaw means thereof are in the clamping position.

10. The clamp in accordance with claim 5 wherein said actuator means comprises lever means pivotally mounted in said housing and a shoulder formed integrally with said carrier whereby when one portion of said lever means is displaced angularly about the pivot point thereof, another portion of said lever means will bear against said shoulder and thereby displace said carrier.

11. The clamp in accordance with claim 10 wherein said shoulder is defined by a cutout in said carrier.

* * * * *